United States Patent [19]

Slager

[11] Patent Number: 4,750,307

[45] Date of Patent: Jun. 14, 1988

[54] WALL CONSTRUCTION AND RESILIENT RUNNER THEREFOR

[75] Inventor: Richard E. Slager, Prospect Heights, Ill.

[73] Assignee: United States Gypsum Company, Chicago, Ill.

[21] Appl. No.: 115,560

[22] Filed: Oct. 29, 1987

Related U.S. Application Data

[63] Continuation of Ser. No. 880,986, Jul. 1, 1986, abandoned.

[51] Int. Cl.[4] ..... E04B 2/60

[52] U.S. Cl. ..... 52/364; 52/735

[58] Field of Search ..... 52/346, 347, 720, 672, 52/726, 735, 633, 764, 483, 489, 715, 531

[56] References Cited

U.S. PATENT DOCUMENTS 3,090,164 5/1963 Nelsson .
3,177,620 4/1965 Brown et al. .
3,333,379 8/1967 Harris ..... 52/364
3,370,391 2/1968 Dupuis ..... 52/346
3,841,047 10/1974 Zinn ..... 52/346
4,170,858 10/1979 Walker ..... 52/346

*Primary Examiner*—John E. Murtagh
*Attorney, Agent, or Firm*—Robert M. Didrick; Robert H. Robinson

[57] ABSTRACT

A buckle-resistant resilient runner having a thickness of from 0.017 to 0.020 inch is interposed between the framework and the wall-board of a partition having a sound transmission coefficient of 53. A scalloped web connects the wallboard support flange and the flange of the runner which is fastened to the framework. The distance between the support flange and a notch in the scalloped web is equal to or greater than the width of a stop flange on the opposite edge of the support flange. This design makes the runner much more resistant to buckling than a prior art runner made from thicker sheet metal.

9 Claims, 2 Drawing Sheets

WALL CONSTRUCTION AND RESILIENT RUNNER THEREFOR

This is a continuation of co-pending application Ser. No. 880,986 filed on July 1, 1986, now abandoned.

This invention relates to a new and improved thin gauge, buckle resistant, resilient manner for the construction of wallboard partitions which reduce the transmission of sound between rooms separated by those partitions.

The use of resilient runners as support surfaces for wallboards in such partitions has been known for many years. In 1963, U.S. Pat. No. 3,090,164 (Nelsson) taught a runner having a base flange in a first plane, a wallboard support flange in a second, parallel plane, and an inclined web connecting them. The placing of the web between the support flange and the base flange which was to be affixed to the framework of the partition imparted resiliency to the runner. Further resiliency was imparted by openings spaced apart in the web. The runner 8 of Nelsson has become well known in the building trade as the RC-1 channel sold by the U.S. Gypsum Company. There has long been a desire, however, to reduce the cost of manufacture of the RC-1 channel and to improve its resiliency so that sound transmission by party wall partitions could be reduced still further. Another problem with the RC-1 channel is that it must be handled with care to prevent it from buckling. The slots in the web of the RC-1 channel have very narrow boundaries between them and the two flanges. It is in these weakened locations that buckling of the runner occurs if the channel is picked up near its midpoint. The cost of the runner could be reduced and its resiliency could be increased by using a thinner sheet of metal in its fabrication but that, without doing more, would only aggravate the buckling problem.

It is an object of this invention, therefore to provide a buckle resistant, resilient runner which is fabricated from sheet metal which is as thin as it can be and still be capable of anchoring a wallboard fastening screw.

It is a another object of this invention to provide a wallboard partition having a high sound transmission coefficient in which the wallboards are separated from the framework by a low cost, lightweight resilient runner.

These and other objects of this invention which will become apparent are achieved by the resilient runner and partition which are described below with reference to the drawings, in which.

Figure 1:
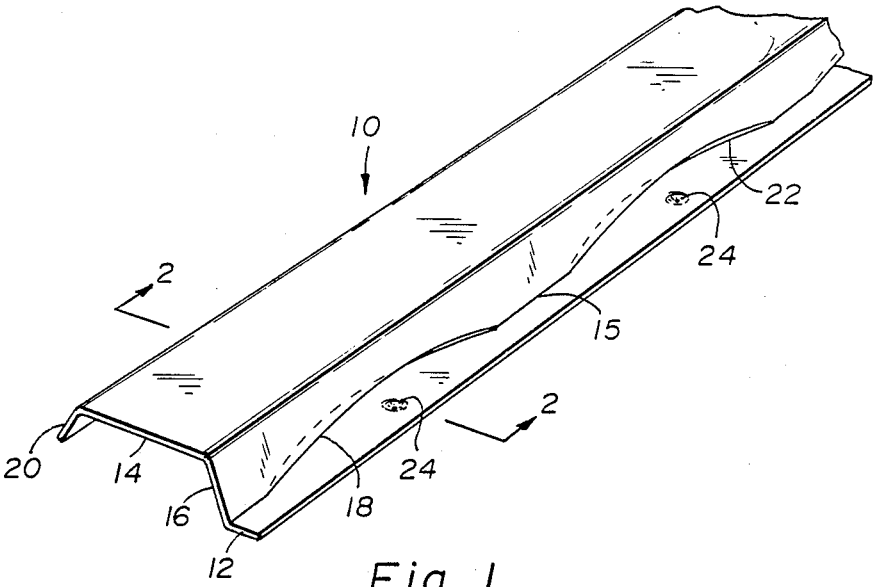
FIG. 1 is a fragmentary perspective view of a preferred embodiment of the resilient runner of this invention.
Figure 2:
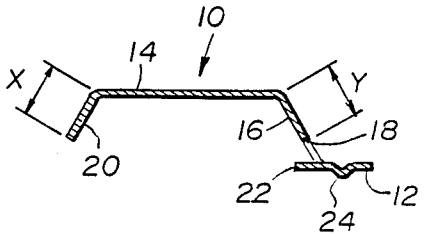
FIG. 2 is a sectional view taken along the line 2—2 of FIG. 1.

IN FIGS. 1 and 2, the elongate resilient runner 10 is made from sheet metal and consists of the base flange 12 which is connected to the wallboard support flange 14 by the stays 15 of the scalloped web 16 which is integral with and inclined at an oblique angle to both the flange 12 and the flange 14. Resiliency is imparted to the runner 10 by said inclination of the web and by the arcuate, elongated notches 18 which interrupt the boundary between the flange 12 and the web 16. The stop flange 20 extends toward the plane of the flange 12 at an acute angle to the plane of the web 16 from the edge of the flange 14 opposite the juncture of said flange and the web 16. The dimension "y" is substantially equal to or greater than the dimension "x". The tabs 22 are residue from the piercing and breaking of flat sheet metal stock in the forming of the scalloped web 16 and the base flange 12. The tabs 22 on the runner 10 provide a wider field on the base flange 12 for the placement and driving of fasteners. The dimples 24, which are convenient markers for the placement of screws, are spaced apart longitudinally along the flange 12 in alignment with the lateral centerline of each arcuate notch 18.

Figure 3:
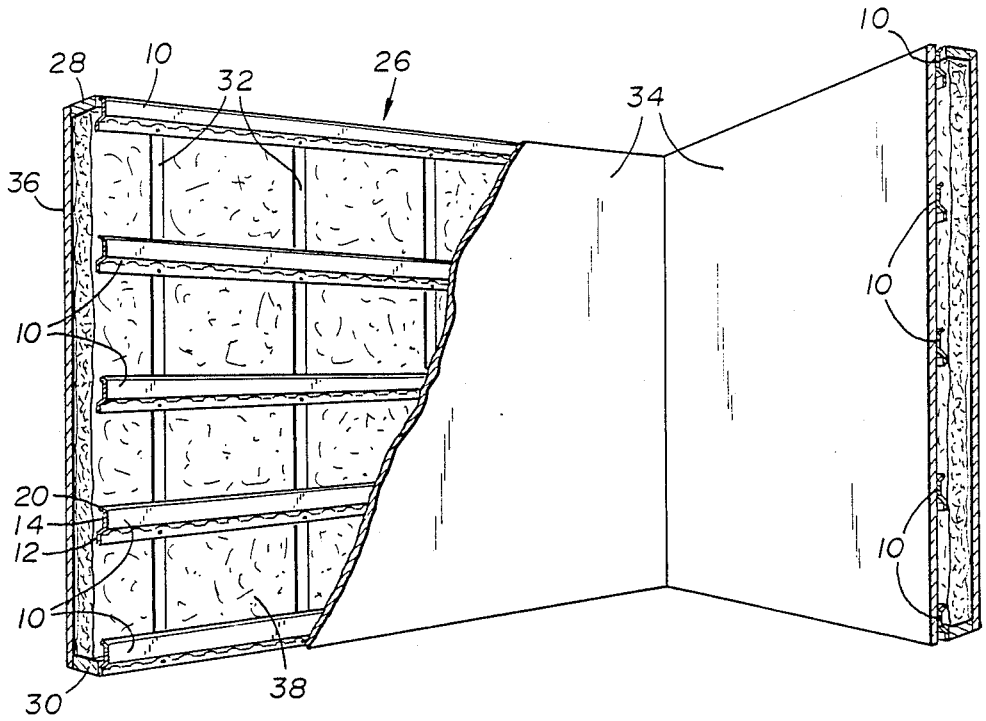
FIG. 3 is an elevational view of a portion of a partition of this invention.

In FIG. 3, the partition 26 is illustrated to show the relationship of the runners 10, the ceiling plate 28, the floor plate 30, the wood studs 32 which connect said plates, and the wallboard 34. The opposing wallboard 36 is fastened directly to the studs 32 and the sound attenuation blankets 38 are stapled inside the cavities. In the construction of the partition 26, the resilient runners 10 are secured transversely to the studs 32 in spaced, parallel relationship to the plates 28 and 30. The runners 10 are preferably oriented so that the support flanges 14 project upwardly from the base flanges 12. Spacing of the runners 10 is appropriately about 2 feet when the conventional 4×8 foot gypsum wallboards are used but the spacing may be varied to accommodate other kinds and sizes of wallboards such as the currently popular 3×5 foot cement boards which are used as tile backer boards. In any event, the runners are placed so that adjacent wallboards 34 can be fastened to a common support flange 14.

Resiliency is enhanced by the removal of the maximum amount of metal from the web 16 by the arcuate notches 18 that is consistent with the retention of the strength required in the web to resist buckling when the runner is picked up and also to bear the load imposed on the webs 16 of each runner in FIG. 3 when the wallboard 34 is installed. The arcuate, elongated notches 18 minimize the area of the web 16 wherein short paths are provided for sound waves from the flange 14 to the stud 32 yet the amount of metal between the apogee of each arcuate notch and the flange 14 provides sufficient strength to the web 16 to resist buckling. Another advantage of the arcuate shape of the notch 18 is that the concentration of stress at specific points on the web 16 is avoided because of the absence of abrupt changes in the cross section of the notch.

In a preferred embodiment of the runner 10 wherein the flange 12 (excluding the tab 22) is about 0.3 inch wide, the web 16 (including the notch 18) is about 0.56 inch wide, the flange 14 is about 1.25 inches wide, and $y=x=0.375$ inch, the span of each notch 18 is about 3 inches and the spacing of the notches is about 4 inches, o.c. Thus, the depth of the notch 18 is about 0.185 inch and the ratio of the span of the notch to the depth of the notch is about 16.1. The width of the sheet metal blank from which the preferred runner 10 is formed is only about 2.5 inches and the galvanized steel sheet is only about 0.017–0.020 inch (0.016 inch minimum before galvanizing). Thus, the cost of material for the preferred runner 10 is much less than for the wall known RC-1 channel which is formed from 3 inch wide or wider blanks which are from 0.021 to 0.025 inch thick after galvanizing. The overall width of the runners 10 may be greater and the metal may be thicker but the extra cost of the material will not buy better performance.

It is important that, regardless of the other dimensions of the runner of this invention, the minimum distance from the flange 14 to the notch 18 is at least substantially equal to or greater than the width of the stop flange 20, e.g., y=x.

Galvanizing of the sheet steel before forming is preferred. The metal blank is drawn through a powered rotary tool which comprises an upper roll having a plurality of lancing tools having the arcuate shape of the notches 18 and a lower roll having a like number of cutting edges which are in register with the lancing tools. The lancing and cutting tools are spaced apart on their respective rolls in order to slit the flat metal at the desired intervals. The dimples 24 may also be stamped into the metal in the same operation. The slit metal strip is then fed into a roll forming machine in which the lower die is routed out to allow the tabs 22 of the base flange 12 to separate from the web portion of the metal along the arcuate slits as the oblique angle between the base flange and the web stays 15 is formed by the upper die alone. The scalloped web 16, the flat tabs 22, and the dimples 24 are thus formed without giving rise to scrap.

In the construction of the partition 26 for a sound transmission loss test, the preferred runners 10 were spaced apart 24" o.c. on one side of commercial, nominally 2"×4" wood studs 32 which were spaced at 16" o.c. intervals. The runners were 0.019 to 0.020" thick. The sound attenuation blankets 38 were 3.5" thick THERMAFIBER mineral fiber blankets having a density of 2.5 lbs./cu. ft. The wallboards 34 and 36 were ⅝" thick SHEETROCK brand FIRECODE gypsum panels and were attached with USG Type S Bugle Head screws at 12" o.c. intervals. The joints between the panels were taped and the perimeter of the partition was sealed on both sides with a single bead of USG Acoustical Sealant. The partition had an FSTC of 53 according to the test which was conducted in general accordance with the ASTM E336-84 Standard Method of Test for "Measurement of Airborne Sound Insulation in Buildings". The FSTC was determined from the test results in strict accordance with the ASTM E413-73 Standard Classification for "Determination of Sound Transmission Class".

The stiffness or resistance to buckling of the preferred runner 10 was compared with that of the well known RC-1 channel. The runner 10 had a thickness of 0.019" and the RC-1 channel was 0.021" thick. An 18" span of each was incrementally loaded at its midpoint until buckling occurred. The ultimate load on the runner 10 was 22.8% greater than that which buckled the RC-1 channel even though the runner 10 was 10% thinner.

Although the invention has thus far been described with reference to the use of the runners on wooden support members for walls it will be understood that the runners may be used in like manner in ceilings. The runners may also be used effectively on sub-structures such as concrete or masonry walls for the same purpose.

While a specific embodiment of the invention has been described in detail, it is understood that various modifications thereof may be made within the spirit and scope of the claimed invention.

The subject claimed is:

1. An elongate runner for the resilient attachment of wallboard to a support, said runner consisting essentially of a base flange lying in a first plane and adapted for attachment to the support; a resilient web lying in a second plane inclined at an angle to the first plane and having a first longitudinal edge which is intermittently joined directly to the base flange; a support flange, substantially parallel to the first plane, joined directly to the web opposite the base flange; and a stop flange joined directly to the support flange opposite the web, said stop flange approaching the first plane at an acute angle to the second plane; said web having a plurality of elongate notches along its first edge which interrupt the boundary between the base flange and the web, the minimum distance between a notch and the support flange being at least substantially equal to the width of the stop flange and a plurality of tabs coplanar with and projecting from the base flange in alignment with web notches and substantially parallel to the support whereby a wider field on the base flange is provided for the placement of fasteners.

2. The runner of claim 1 wherein the ratio of the span of the notch to the depth of the notch is about 16.1.

3. The runner of claim 1 characterized further by a thickness of from about 0.017 inch to 0.020 inch.

4. The runner of claim 1 wherein the notches are arcuate.

5. A wall construction comprising:

a substantially planar sub-structure;

an elongate runner for resiliently attaching wallboard to said sub-structure, said runner consisting essentially of:

a base flange attached to the sub-structure in a first plane substantially parallel to the plane of said sub-structure;

a resilient web lying in a second plane inclined at an angle to the first plane and having a first longitudinal edge which is intermittently joined directly to the base flange;

a support flange, substantially parallel to the first plane, joined directly to a second longitudinal edge of the web opposite the base flange; and a stop flange joined directly to the support flange opposite the web and approaching the sub-structure at an acute angle to the second plane;

said web having a plurality of elongate notches along its first edge which interrupt the boundary between the base flange and the web, the minimum distance between a notch and the support flange being at least substantially equal to the width of the stop flange and a plurality of tabs coplanar with and projecting from the base flange in alignment with web notches and substantially parallel to the sub-structure whereby a wider field on the base flange is provided for the placement of fasteners;

and a wallboard attached to the support flange of the runner.

6. The construction of claim 5 wherein the ratio of the span of the notch to the depth of the notch is about 16:1.

7. The construction of claim 5 characterized further by a plurality of tabs on the base flange in alignment with the web notches and substantially parallel to the sub-structure.

8. The construction of claim 5 characterized further in that the runner is from about 0.017 inch to about 0.020 inch thick.

9. The wall construction of claim 5 wherein the notches along the first edge of the web of the runner are arcuate.

* * * * *

UNITED STATES PATENT AND TRADEMARK OFFICE

CERTIFICATE OF CORRECTION

PATENT NO. : 4,750,307

DATED : June 14, 1988

INVENTOR(S) : Richard E. Slager

It is certified that error appears in the above—identified patent and that said Letters Patent is hereby corrected as shown below: On the title page:

In the Abstract:

Line 3, change "wall-board" to --wallboard--.

In the Specification:

Column 1, Line 8, change "manner" to --runner--.

Column 2, line 60, change "wall" to --well--.

Signed and Sealed this

Eighth Day of November, 1988

*Attest:*

DONALD J. QUIGG

*Attesting Officer*

*Commissioner of Patents and Trademarks*